US008669905B2

(12) United States Patent
Hillersborg

(10) Patent No.: US 8,669,905 B2
(45) Date of Patent: Mar. 11, 2014

(54) PORTABLE COMMUNICATION DEVICE COMPRISING AN ANTENNA

(75) Inventor: Per Hillersborg, Solrød Strand (DK)

(73) Assignee: Sennheiser Communications A/S, Solrod Strand (DK)

( * ) Notice: Subject to any disclaimer, the term of this patent is extended or adjusted under 35 U.S.C. 154(b) by 369 days.

(21) Appl. No.: 12/886,044

(22) Filed: Sep. 20, 2010

(65) Prior Publication Data

US 2011/0068985 A1 Mar. 24, 2011

Related U.S. Application Data

(60) Provisional application No. 61/244,091, filed on Sep. 21, 2009.

(30) Foreign Application Priority Data

Sep. 21, 2009 (EP) ..... 09170802

(51) Int. Cl.
*H01Q 1/24* (2006.01)

(52) U.S. Cl.
USPC ..... 343/702; 343/700 MS; 343/829; 343/846; 343/872; 343/873

(58) Field of Classification Search
USPC ..... 343/702
See application file for complete search history.

(56) References Cited

U.S. PATENT DOCUMENTS 5,995,048 A 11/1999 Smithgall et al.

(Continued)

FOREIGN PATENT DOCUMENTS

| | | | |
|---|---|---|---|
| WO | WO 01/03243 | A1 | 1/2001 |
| WO | WO 02/35810 | A1 | 5/2002 |
| WO | WO 2005/041352 | A1 | 5/2005 |
| WO | WO 2007/019885 | A1 | 2/2007 |

OTHER PUBLICATIONS

J. Bartolic, Planar and Cylindrical Microstrip Patch Antennas and Arrays for Wireless Communications, Apr. 17-20, 2001, Conference Puplication No. 480 IEEE, 11th International Conference on Antennas and Propagation.*

(Continued)

*Primary Examiner* — Jerome Jackson, Jr.
*Assistant Examiner* — Hai Tran
(74) *Attorney, Agent, or Firm* — Birch, Stewart, Kolasch & Birch, LLP

(57) ABSTRACT

The invention relates to a communication device comprising a wireless interface for enabling wireless transmission and/or reception at a predefined wavelength $\lambda_c$ to be established. The object of the present invention is to provide an antenna suitable for wireless communication in a portable communication device. The problem is solved in that the communication device comprises a housing having an electrically conductive part, the wireless interface comprising an antenna comprising a first quarter wavelength patch and a ground plane comprising an electrically conductive material, the first quarter wavelength patch being at least partially constituted by said electrically conductive part of the housing. This has the advantage of providing an alternative wireless interface for a communication device. The invention may e.g. be used in portable communication devices with a wireless interface for communication with another device, in particular in a headset or a headphone or an active earplug.

24 Claims, 4 Drawing Sheets

(56) References Cited

U.S. PATENT DOCUMENTS

| | | | | |
|---|---|---|---|---|
| 6,995,709 | B2 * | 2/2006 | Spittler | 343/700 MS |
| 7,319,433 | B2 | 1/2008 | Rosenberg et al. | |
| 7,518,553 | B2 * | 4/2009 | Zhang et al. | 343/700 MS |
| 7,629,932 | B2 * | 12/2009 | Wang et al. | 343/702 |
| 2004/0036656 | A1 | 2/2004 | Nevermann | |
| 2004/0051675 | A1 | 3/2004 | Inoue | |
| 2006/0109182 | A1 | 5/2006 | Rosenberg et al. | |
| 2006/0109183 | A1 | 5/2006 | Rosenberg et al. | |
| 2009/0284423 | A1 * | 11/2009 | Yi et al. | 343/702 |

OTHER PUBLICATIONS

Taguchi, Analysis of Dipole Antenna Printed on Thin Film by Using Electromagnetic Simulators, 2005, ACES.*

* cited by examiner

PORTABLE COMMUNICATION DEVICE COMPRISING AN ANTENNA

CROSS REFERENCE TO RELATED APPLICATIONS

This nonprovisional application claims the benefit under 35 U.S.C 119(e) to U.S. Provisional Application No. 61/244,091 filed on Sep. 21, 2009 and under 35 U.S.C 119(a) to EP 09170802.4 filed on Sep. 21, 2010. The entire contents of the above applications are hereby incorporated by reference into the present application.

TECHNICAL FIELD

The present invention relates to communication devices, in particular to antennas for communication devices. The invention relates specifically to a communication device comprising a wireless interface for enabling wireless transmission and/or reception at a predefined wavelength $\lambda_c$ to be established.

The invention may e.g. be useful in applications such as portable communication devices with a wireless interface for communication with another device, in particular in a headset or a headphone or an active earplug.

BACKGROUND ART

The provision of sufficient bandwidth and reasonable efficiency of an antenna in a portable communication device is a general problem. Ideally, an antenna for radiation of electromagnetic waves at a given frequency should have dimensions larger than or equal to half the wavelength of the radiated waves at that frequency. At 860 MHz, e.g., the wavelength in vacuum is around 35 cm. At 2.4 GHz, the wavelength in vacuum is around 12 cm. Thus for a state of the art communication device having external dimensions less than 6 cm (e.g. headsets) and even less than 5 cm and often less than 2 cm or 1 cm (e.g. hearing instruments), it can in practice difficult to provide an antenna with appropriate technical specifications at 2.4 GHz (in view of the typical limited power supply of a portable (e.g. battery driven) communication device).

US 2006/0109182 A1 describes an antenna device for a portable device having an antenna loop of conducting material to be connected to radio circuitry in the portable device. The antenna loop is positioned opposite a ground plane of a PCB. The antenna device also comprises at least one battery, which is positioned in the extension of a first side of the PCB, and acts as an extension of the ground plane of the PCB.

US 2006/0109183 A1 describes a folded wideband loop antenna comprising sections extending in first and second separate parallel planes, wherein the loop antenna sections form a three-dimensional structure having a substantial two-dimensional extension in at least one of the first and second planes.

DISCLOSURE OF INVENTION

An object of the present invention is to provide an antenna suitable for wireless communication in a portable communication device.

Objects of the invention are achieved by the invention described in the accompanying claims and as described in the following.

A Communication Device:

An object of the invention is achieved by a communication device comprising a wireless interface for enabling wireless transmission and/or reception at a predefined wavelength $\lambda_c$ to be established, the communication device comprising a housing having an electrically conductive part, the wireless interface comprising an antenna comprising a first quarter wavelength patch and a ground plane comprising an electrically conductive material, the first quarter wavelength patch being at least partially constituted by said electrically conductive part of the housing.

This has the advantage of providing an alternative wireless interface for a communication device.

In the present context a 'patch' is taken to mean a rectangular (e.g. quadratic) structure. A 'patch antenna' is taken to mean a rectangular metal plate separated from a ground plane by an electrically insulating material. A 'quarter wavelength patch antenna' comprises a rectangular patch where two of the opposing edges (one of the edges connected to the ground plane) are one quarter of an operating wavelength long (the direction defined thereby being termed a longitudinal direction of the structure).

In an embodiment, the first quarter wavelength patch and the ground plane are separated by an electrically insulating layer. In an embodiment, a part of the electrically insulating layer is constituted by a solid dielectric material. In an embodiment, the antenna comprises at least one electrical RF-connection between the first quarter wavelength patch and the ground plane. An electrical RF (=Radio Frequency) connection is here taken to mean an electrical connection at the frequency of operation ($\sim c/\lambda_c$, where c is the speed of light in vacuum). In an embodiment, a frequency of operation is in the range from 300 MHz to 6 GHz.

In an embodiment, the first quarter wavelength patch is shorted to the ground plane at an ('cold') end of the patch. In an embodiment, the first quarter wavelength patch is defined by a radiating (or 'hot') end of the patch and an end comprising one or more electrical connections to the ground plane (said end constituting a 'cold' end), so that the distance on the patch from the radiating (or 'hot') end to a point of connection to the ground plane (the 'cold' end) is a quarter wavelength ($\lambda_c/4$).

In an embodiment, the first patch is the driven patch. In other words, the antenna structure is constituted by the first patch (forming part of the housing) and the ground plane.

In an embodiment, the first patch is electromagnetically coupled to an underlying driven antenna part, the first patch thus becoming a parasitic patch of the antenna. Because the first patch form part of the housing of the communication device, it will be exposed to human handling, but the present configuration of the antenna has the advantage that the antenna is less sensitive to such handling (e.g. in the form of a hand of the person using the device) because the driven antenna is electromagnetically shielded by the parasitic patch. An antenna structure comprising a parasitic patch and an underlying driven antenna part (e.g. a quarter wavelength patch or a half wavelength loop antenna part) and a ground plane is thus advantageous for handheld portable devices (e.g. headset applications) compared to a single patch antenna solution.

In an embodiment, the electromagnetic (EM) coupling between the driven antenna and the first patch is adapted to provide an antenna comprising a double resonance.

In an embodiment, the first patch is connected to the ground plane via an RF short circuit comprising a capacitive coupling.

In an embodiment, the first quarter wavelength patch constitutes only a part of the electrically conductive part of the housing. In an embodiment, the excess part is coupled to ground via an RF-coupling, e.g. a capacitive coupling. This ensures that the electrically conductive part of the housing, although having a dimension in excess of a quarter of an operating wavelength, effectively works as a quarter wavelength patch.

In an embodiment, the antenna comprises an intermediate, driven, quarter wavelength patch that is electromagnetically (EM) coupled to the first quarter wavelength patch.

In an embodiment, the driven patch is driven by a pin through the underlying ground plane. Preferably the patch is driven at a point halfway between opposing edges of the patch, said edges being parallel to a direction of the patch in which the dimension is one quarter of an operating wavelength.

In an embodiment, the driven patch is driven by a micro strip line, which is coplanar with the patch. Preferably, the patch is driven from a midpoint of an edge of the patch.

In an embodiment, the antenna comprises an intermediate, driven, shorted loop half-wavelength antenna that is EM-coupled to the first quarter wavelength patch.

In an embodiment, the shorted loop is the driven element of the antenna, i.e. the loop element is connected to transceiver circuitry of the wireless interface. An advantage of using a (planar) loop instead of a patch as the driven element of the antenna is that it provides an increased flexibility in the localization of the electrical connection to the transceiver (no or less location (symmetry) considerations to comply with). In an embodiment, the loop antenna is driven at a point along the periphery of the loop. In an embodiment, the loop antenna is driven at a point located a predefined distance from a point of connection of the loop antenna to the ground plane. In an embodiment, the distance between a driving point and a grounding point is in the range from $0.1\cdot(\lambda_c/2)$ to $0.3\cdot(\lambda_c/2)$, such as in the range from $0.15\cdot(\lambda_c/2)$ to $0.25\cdot(\lambda_c/2)$, e.g. around $0.2\cdot(\lambda_c/2)$.

In an embodiment, the loop opening of the half-wavelength loop antenna is adapted to allow other constructional parts of the device, e.g. electronic components, to extend through the opening, thereby allowing a more compact device structure. Similarly, in an embodiment, the outer periphery of the half-wavelength loop antenna is adapted in form to comply with other restrictions of the device, e.g. to allow to allow other constructional parts of the device (e.g. components extending through the housing, e.g. a button) to be located along its periphery.

In the present context, the housing is taken to be a structural part of the device enclosing and/or supporting some, such as a majority or all of the components constituting the device, including electronic components of the device, other parts of the antenna, etc. In an embodiment, the housing constitutes the outer spatial confinement of the device (or of a distinct part of the device, e.g. a part comprising a transceiver).

In a particular embodiment, the antenna comprises a stacked structure, the stacked structure at least comprising the following layers:

- A first layer comprising the ground plane comprising an electrically conductive material,
- A second layer comprising an electrically insulating material,
- A third layer comprising a second patch comprising an electrically conductive material, the second patch being electrically connected to the ground plane, said patch being adapted to constitute a quarter-wavelength antenna at said predefined wavelength $\lambda_c$,
- A fourth layer comprising an electrically insulating material, and
- A fifth layer comprising the first patch comprising an electrically conductive material, wherein the stacked structure is adapted to provide that the first patch of the fifth layer is electromagnetically coupled to the second patch of the third layer.

In a particular embodiment, the first and second patches are adapted to provide a double resonance to increase the bandwidth of the antenna.

In a particular embodiment, the antenna comprises a stacked structure, the stacked structure at least comprising the following layers:

- A first layer comprising the ground plane comprising an electrically conductive material,
- A second layer comprising an electrically insulating material,
- A third layer comprising a shorted loop comprising an electrically conductive material, the ends of the loop being electrically connected to the ground plane, said loop being adapted to constitute a half-wavelength antenna at said predefined wavelength $\lambda_c$,
- A fourth layer comprising an electrically insulating material, and
- A fifth layer comprising the first patch comprising an electrically conductive material, wherein the stacked structure is adapted to provide that the first patch of the fifth layer is electromagnetically coupled to the shorted loop of the third layer.

In the present context, the term a 'stacked structure' is taken to mean an arrangement of different (not necessarily all solid) functional layers in a sequential order (not necessarily co-parallel). In an embodiment, the layers of the stacked structure are substantially co-planar, so that the layers have a common normal vector perpendicular to the co-parallel planes (one of them being the ground plane). In an embodiment, the spatial extension of the stacked structure in a direction along the common normal vector is smaller than its spatial extension in any of the other spatial directions of the structure. In an embodiment, the term a 'stacked structure' is taken to mean an arrangement of different (not necessarily all solid) functional layers that are conform (i.e. having substantially identical—but not necessarily planar—form).

In a particular embodiment, a sixth layer comprising an electrically insulating material at least partially covering said first patch is provided. Such layer can e.g. be an insulating coating of the metallic part of the housing (e.g. an oxide layer originating from a hard anodizing process of an Aluminium-part).

In a particular embodiment, said ground plane is formed on an insulating substrate, e.g. on a printed circuit board (PCB).

In a particular embodiment, said insulating substrate supports a number of components forming part of the communication device.

In a particular embodiment, said second layer comprises insulating parts of said components mounted on said insulating substrate.

In a particular embodiment, said second layer comprises said insulating layer of said insulating substrate. In other words, the ground plane is formed on a face of the insulating substrate so that the insulating substrate is located between the ground plane and the shorted loop. In an embodiment, the ground plane is surrounded by insulating material on both sides, e.g. forming part of a multi-layer structure, e.g. being an interior layer of a multi-layer printed circuit board.

In a particular embodiment, said loop is constituted by a single closed loop of a metallic material, e.g. Cu, Ag or Al or an Ni—Ag- or an Cu—Ni—Zn-alloy.

In a particular embodiment, the first patch is capacitively coupled to the shorted loop. Preferably, the capacitance between the shorted loop and parasitic patch element(s) is adapted to represent an electrical RF-short circuit at the operating wavelength of the wireless interface. Alternatively, a direct galvanic connection, e.g. implemented by one or more gold contacts, can be used. The capacitive coupling has the advantage of providing a good ESD protection (ESD=ElectroStatic Discharge) and is achieved by adapting the area of the terminal(s) connecting to the shorted loop and facing the first parasitic patch, the distance between the terminal(s) and the first parasitic patch, and the kind of dielectric material between terminal(s) and parasitic patch. The dielectric material and its thickness are preferably adapted to be able to withstand an electrostatic voltage larger than 3 kV, such as larger than 5 kV.

In a particular embodiment, the fourth layer comprises a polymer, e.g. in the form of an adhesive tape. In an embodiment, the fourth layer comprises a polyimide layer of a flexprint. In an embodiment, the fourth layer comprises an ESD protective tape, e.g. a polyimide tape (e.g. Kapton® from Dupont). In an embodiment, an ESD tape is used as insulating layer between a connection to the shorted loop and the parasitic patch of the fifth layer. This has the advantage of providing a good, controllable (reproducible) capacitive coupling between the (driven) shorted loop and the parasitic patch.

In a particular embodiment, the fourth layer comprises a plastic part, which forms part of the housing of the communication device or supports the metallic part of the housing. In an embodiment, the plastic part comprises areas specifically adapted to receive a specific insulating material.

In a particular embodiment, the wireless interface comprises a transceiver for driving the antenna and/or receiving signals from the antenna.

In a particular embodiment, the loop is electrically coupled to said transceiver.

In a particular embodiment, said transceiver is at least partially implemented by one or more electronic components on said insulating substrate.

In a particular embodiment, the stacked structure is arranged to have a longitudinal direction in a direction parallel to the ground plane of the first layer, the shorted loop or patch having a first shorted end connected to the ground plane and a second radiating loop-end or patch-end when viewed in said longitudinal direction, the ground plane extending in said longitudinal direction beyond the shorted loop or patch, respectively, at least in said radiating end of said antenna parts.

In a particular embodiment, the shorted loop (or patch) is arranged to extend beyond the first (parasitic) patch of the fifth layer at least in said loop-end (or patch-end) of the shorted loop (or patch). Alternatively, the first (parasitic) patch of the fifth layer is arranged to extend beyond the shorted loop (or patch) at least in said loop-end (or patch-end) of the respective antenna parts.

In an embodiment, the wireless interface (including the antenna) is adapted for transmission and/or reception in unlicensed ISM-like frequency bands (ISM=Industrial, Scientific and Medical) as e.g. defined by the ITU Radiocommunication Sector (ITU-R). In an embodiment, the wireless interface (including the antenna) is adapted for transmission or reception in a frequency range having a centre frequency larger than 300 MHz, e.g. around 865 MHz or around 2.4 GHz. In an embodiment, the wireless interface (including the antenna) is adapted for transmission or reception at frequencies located in the range from 300 MHz to 6 GHz, e.g. in the range from 500 MHz to 1 GHz.

In a particular embodiment, the antenna is adapted to have a bandwidth which is larger than 5% of the centre frequency, such as larger than 8%, such as larger than 10%, such as larger than 20% of the centre frequency. In a particular embodiment, the antenna is adapted to have a bandwidth, which is larger than 100 MHz, such as larger than 200 MHz. such as larger than 400 MHz. In an embodiment, the antenna is adapted to have a centre frequency of 2.441 GHz.

In a particular embodiment, the communication device is a portable device, typically comprising an energy source, e.g. a battery, e.g. a rechargeable battery. In a particular embodiment, the communication device comprises a listening device, e.g. a headset, an active earplug, a hearing instrument, a headphone or a mobile telephone or combinations thereof.

In an embodiment, the wireless interface (including the antenna) is adapted to send and/or receive signals according to a wireless communication standard, e.g. Bluetooth.

In an embodiment, the antenna has dimensions that fit small portable devices, e.g. having maximum dimensions less than 75 mm, such as less than 50 mm, such as less than 25 mm, such as less than 10 mm. In an embodiment, the antenna is adapted to fit into a headset adapted to be worn at least partially at an ear of a user or a hearing instrument adapted to be worn at an ear or in an ear canal of a user.

In the present contest, the term 'a user' or 'a wearer' in connection with a device is intended to mean a person using or wearing the device in question, e.g. 'a user' or 'a wearer' of a listening device refers to a person using and wearing the listening device in an operational position, e.g. at or in an ear of the person.

A First Antenna:

In an aspect, a first antenna comprising a stacked structure is provided, the stacked structure at least comprising

- A first layer comprising a ground plane comprising an electrically conductive material,
- A second layer comprising an electrically insulating material,
- A third layer comprising a shorted loop comprising an electrically conductive material, the ends of the loop being electrically connected to the ground plane, said loop being adapted to constitute a half-wavelength antenna at said predefined wavelength $\lambda_c$.
- A fourth layer comprising an electrically insulating material, and
- A fifth layer comprising a patch comprising an electrically conductive material, said patch being adapted to constitute a quarter-wavelength antenna at said predefined wavelength $\lambda_c$, wherein the stacked structure is adapted to provide that the patch of the fifth layer is electromagnetically coupled to the shorted loop of the third layer.

It is intended that the structural features of the communication device described above, in the detailed description of 'mode(s) for carrying out the invention' and in the claims can be combined with the first antenna when appropriate.

In an embodiment, the first antenna is integrated in a communication device comprising a wireless interface for enabling wireless transmission and/or reception at a predefined wavelength $\lambda_c$ to be established. The communication device comprises a housing having an electrically conductive part, wherein the quarter-wavelength patch of the fifth layer of the first antenna is at least partially (e.g. mainly, such as fully) constituted by the electrically conductive part of the housing.

A Second Antenna:

In a further aspect, a second antenna comprising a stacked structure is provided, the stacked structure at least comprising

- A first layer comprising the ground plane comprising an electrically conductive material,
- A second layer comprising an electrically insulating material,
- A third layer comprising a patch comprising an electrically conductive material, the patch being electrically connected to the ground plane, said patch being adapted to constitute a quarter-wavelength antenna at said predefined wavelength $\lambda_c$,
- A fourth layer comprising an electrically insulating material, and
- A fifth layer comprising a patch comprising an electrically conductive material, said patch being adapted to constitute a quarter-wavelength antenna at said predefined wavelength $\lambda_c$, wherein the stacked structure is adapted to provide that the patch of the fifth layer is electromagnetically coupled to the patch of the third layer.

It is intended that the structural features of the communication device described above, in the detailed description of 'mode(s) for carrying out the invention' and in the claims can be combined with the second antenna when appropriate.

In an embodiment, the second antenna is integrated in a communication device comprising a wireless interface for enabling wireless transmission and/or reception at a predefined wavelength $\lambda_c$ to be established. The communication device comprises a housing having an electrically conductive part, wherein the quarter-wavelength patch of the fifth layer of the second antenna is at least partially (e.g. mainly, such as fully) constituted by said electrically conductive part of the housing.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1:
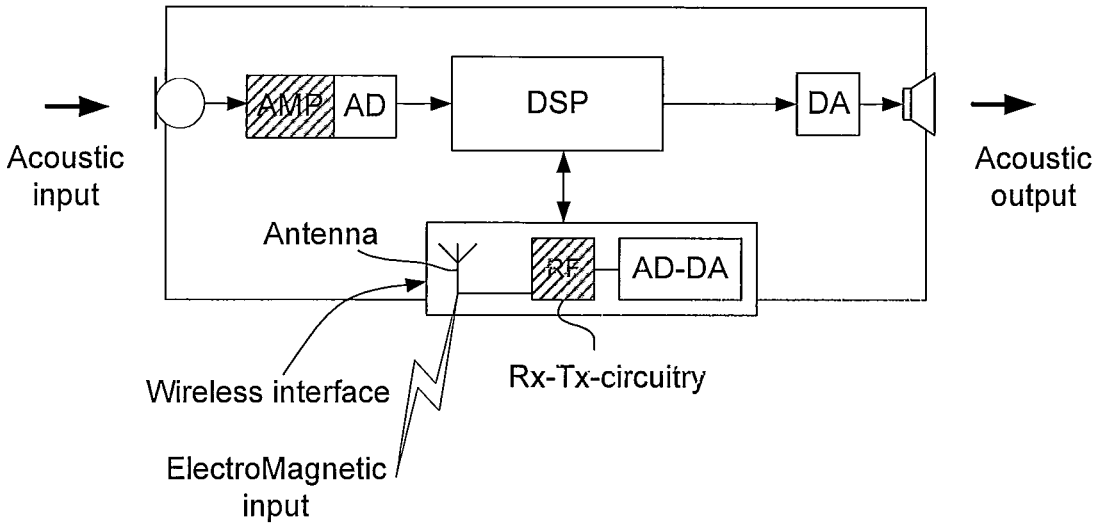
FIG. 1 shows a communication device comprising a wireless interface.

FIG. 1 shows a communication device comprising a wireless interface. The communication device, e.g. a headset, a protective earplug or a hearing instrument, comprises a microphone system (comprising one or more microphones) for converting an acoustic input sound to an electric input signal, an amplifier (AMP) and an analogue to digital converter (AD) for providing a digitized electric input signal representative of the acoustic sound. The communication device further comprises a signal processor (DSP) for processing the digitized electric input signal (e.g. for applying a frequency dependent gain to the signal according to a users' needs (e.g. in a hearing instrument) or for otherwise enhancing and/or encoding the input signal (e.g. in a headset)). The communication device further comprises a digital to analogue (DA) converter and an output transducer (here a speaker; in hearing aid applications often termed a 'receiver') for presenting a signal from the signal processor to a user as an acoustic output. In addition, the communication device comprises a wireless interface for enabling wireless transmission and/or reception to/from another device at a predefined wavelength $\lambda_c$ to be established. The wireless interface is connected to the signal processor (DSP) and comprises an antenna, a transceiver (RF, Rx-Tx-circuitry) and an analogue to digital and digital to analogue converter (AD-DA). In a headset application, the microphone signal is transmitted via the wireless interface, and the signal presented to the user as an acoustic signal by the speaker is received via the wireless interface. In both cases the signals are processed by the signal processor before, respectively, being transmitted via the wireless interface and forwarded to the speaker. Via the wireless link an electromagnetically received audio signal (Electro-Magnetic input), e.g. from a mobile telephone or a PC, can be connected to the signal processing unit via the wireless interface and presented to the user via the speaker. Alternatively or additionally (e.g. in a hearing aid application) the signal picked up by the microphone may be presented to the user. Additionally or alternatively, control signals for controlling settings or updating software of the communications device can be uploaded via the wireless link. In a headset application, the signal picked up by the microphone (e.g. a user's own voice) is forwarded to the wireless interface via the signal processing unit and transmitted to another device, e.g. a mobile telephone or a PC, via the wireless link.

FIG. 2 shows an antenna for a communication device according to an embodiment of the invention. The antenna adapted for wireless transmission and/or reception at a predefined wavelength $\lambda_c$ comprises a stacked structure comprising at least the following five layers:

- A first layer comprising a ground plane comprising an electrically conductive material. The ground plane may be constituted by a metallic layer of a printed circuit board (PCB).
- A second layer comprising an electrically insulating material of a predefined thickness. The electrically insulating material may e.g. be constituted (at least partly) by insulating parts of components mounted on a PCB and the air around them.
- A third layer e.g. comprising a loop comprising an electrically conductive material. The loop may be constituted by a planar loop (an annular ring) of a metallic foil or sheet. Alternatively, the loop may be implemented on a PCB (e.g. on a flex-PCB). The loop is shorted to the ground plane at both ends of the loop, the end-to-end length of the loop from one ground connection to the other being adapted to constitute a half wavelength loop at the operating wavelength (e.g. at a maximum wavelength of the intended frequency range of operation, or at a centre wavelength of the range). Alternatively, the third layer may be constituted by a standard quarter wavelength patch.
- A fourth layer comprising an electrically insulating material. The electrically insulating material may e.g. be constituted by an insulating supporting part for the metallic part of the housing of the device. Alternatively or additionally, the insulating layer may be at least partly constituted by an insulating tape, e.g. an ESD-tape, or by air.
- A fifth layer comprising a (first) patch comprising an electrically conductive material. The stacked structure is adapted to provide that the patch is EM-coupled to the shorted loop of the third layer. The patch may be at least partially constituted by said (or a part of said) electrically conductive part of the housing. Alternatively or additionally, the patch may be constituted by a metallic layer supported by a printed circuit board (PCB), e.g. supported by the fourth layer of insulating material, e.g. supported by (the opposite side of) the insulating layer of a printed circuit board (PCB) of the fourth layer. The patch is preferably adapted to constitute a quarter wavelength patch at the operating wavelength. The patch is preferably made of a metallic material, e.g. a material comprising stainless steel, Cu or Al (e.g. anodized Al).

Figure 2A:
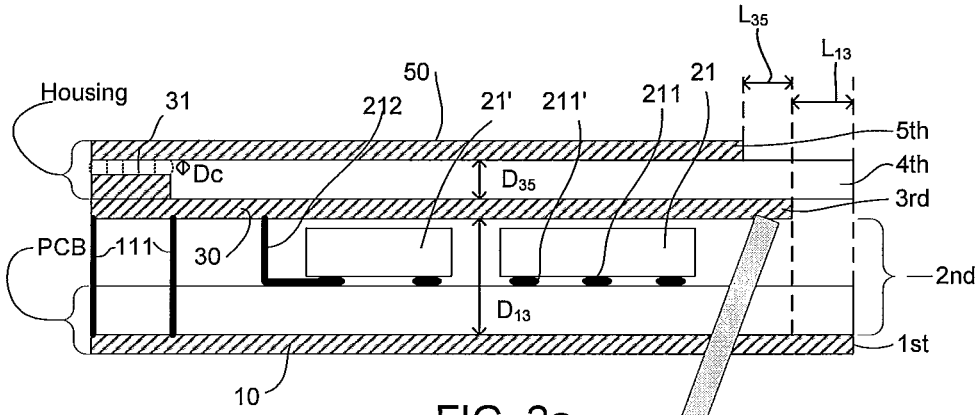
FIG. 2 shows an antenna for a communication device according to an embodiment of the invention.
Figure 2B:
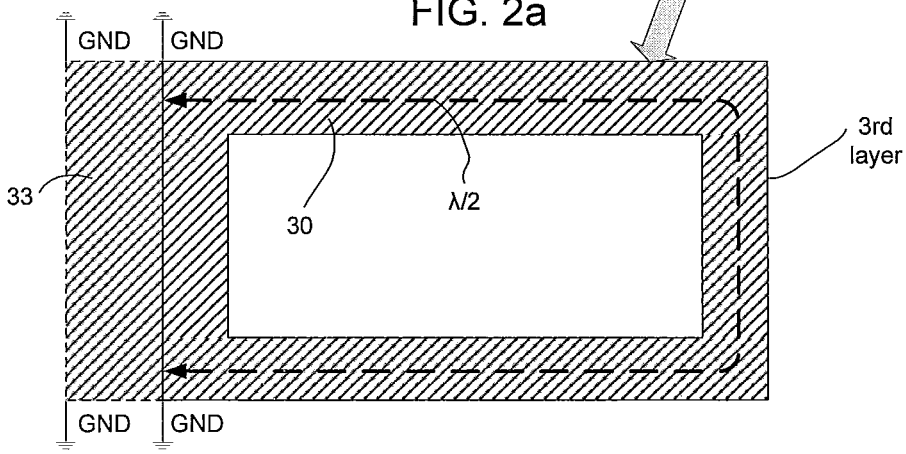

In the embodiment shown in FIG. 2, an insulating layer of the PCB on which the ground plane 10 ($1^{st}$ layer) is laid out, comprises a part of the insulating second layer ($2^{nd}$) (cf. reference PCB in FIG. 2*a*). On the other side (relative to the ground plane) of the insulating layer of the PCB, a number of electronic components 21, 21' (here two are shown) are (surface) mounted and possibly mutually interconnected via conductive wire patterns on an insulating layer of the PCB to which the terminals 211, 211' of the components are soldered. Another part of the insulating second layer ($2^{nd}$) is constituted by the insulating parts of the electronic components 21, 21' and the air surrounding them. Preferably, a conductive ground pattern is provided on the surface of the insulating layer comprising wiring for connecting the electronic components 21, 21'. In an embodiment, the conductive ground pattern constitutes the ground plane. In an embodiment, the conductive ground pattern is electrically connected to an underlying ground plane (and thereby forms part of the ground of the antenna). The conductive loop 30 ($3^{rd}$ layer) is electrically connected to the ground plane 10 ($1^{st}$) layer via electric connections 111 between them. The patch 50 ($5^{th}$ layer) is electromagnetically coupled to the conductive loop layer). An RF-ground coupling from the patch 50 to the conductive loop 30 (here) in the form of a capacitive coupling in the vicinity of a galvanic coupling 111 from the conductive loop ($3^{rd}$ layer) to the ground plane 10 ($1^{st}$ layer) is indicated by reference numeral 31 and dotted lines symbolizing the electric field. The distance $D_c$ between the electrically conductive elements of the $3^{rd}$ layer (specifically the parts responsible for the RF-ground coupling) and $5^{th}$ layers is indicated; the smaller $D_c$ the larger the capacitive RF-ground coupling ($D_c$ being smaller than the general distance $D_{35}$ between loop antenna part of the $3^{rd}$ layer and the patch of the $5^{th}$ layer). As shown in FIG. 2*b*, the RF-ground connection between the $5^{th}$ (first patch) and the $1^{st}$ layers (ground) is formed via the $3^{rd}$ layer (comprising the driven $\lambda_c/2$-loop antenna) to an electrically conductive part 33 of the $3^{rd}$ layer that is NOT an active part of the half-wavelength loop antenna (the part 33 is galvanically connected to ground plane 10). The annular conductor forming the conductive loop of the $3^{rd}$ layer is sufficiently wide (and thick) to provide a relatively low resistance appropriate for the resonance frequency and antenna efficiency aimed at. As illustrated in FIG. 2*b*, the loop is adapted to constitute a half-wavelength antenna, i.e. having dimensions of the order of one half wavelength $\lambda_c$ of the transmitted or received electromagnetic waves (as counted around the (middle) path of the loop from one shorted end of the loop to the other (cf. dotted arrow and ground symbols GND in FIG. 2*b*). Twice the distance $D_{13}$ between $1^{st}$ and $3^{rd}$ layers should be included in the determination of the half wavelength dimension (not shown for simplicity). At 2.4 GHz, e.g., the wavelength in vacuum is around 12 cm, i.e. a half wavelength antenna has a loop length around 6 cm. The transceiver component 21 for driving the loop and for receiving signals received by the loop is electrically connected to the loop via electrical connection 212. The $4^{th}$, insulating layer and $5^{th}$ patch layer are in this example fully or partially constituted by constructive parts of the housing of the communication device (cf. reference Housing in FIG. 2*a*), i.e. they form part of the outer enclosure of the device, i.e. are parts of the casing surrounding the components of the communication device (including the electronic components shown on FIG. 1 and the other layers of the antenna). To provide an appropriate coupling between the elements of the antenna, the ground plane ($1^{st}$ layer) extends beyond the extension of the shorted loop antenna ($3^{rd}$ layer) in a planar longitudinal direction away from the shorted end of the loop (as indicated by dimension $L_{13}$ in FIG. 2*a*). To provide most of the radiation away from the head of a wearer of the device the ground plane extends beyond the loop antenna (assuming that the ground plane faces the head of the wearer). Likewise the shorted loop element ($3^{rd}$ layer) extends beyond the extension of the parasitic patch of the $5^{th}$ layer in a planar longitudinal direction away from the shorted end of the loop (as indicated by dimension $L_{35}$ in FIG. 2*a*) to control the amount of electromagnetic coupling between the $3^{rd}$ and $5^{th}$ layer. In an embodiment, the extension $L_{35}$ of the shorted loop element (or alternatively a ($\lambda_c/4$)-patch) beyond the first (parasitic) patch is in the mm-range, e.g. in the range from 0.5 to 2 mm, e.g. around 1 mm (e.g. for a frequency of operation in the GHz-range, e.g.

around 2.4 GHz). Distances $D_{13}$ between the $1^{st}$ and $3^{rd}$ layers and $D_{35}$ between the $3^{rd}$ and $5^{th}$ layers are adapted to provide appropriate EM-coupling and thereby bandwidth of the antenna at the frequency of operation. In general, the larger $D_{13}$, $D_{35}$ the lower Q, and thus the larger the bandwidth of the antenna. The purpose of the parasitic patch is to provide a larger bandwidth (by introducing a double resonance). In an embodiment, $D_{13}$ is around 2.4 mm. In an embodiment, $D_{35}$ is around 1.6 mm. Primary design parameters to control bandwidth are distances $L_{35}$ and $D_{35}$ (and to smaller degree $D_{13}$). To achieve maximum bandwidth, the location of the feeding point on the loop periphery (cf. $D_{d\text{-}g}$ in FIG. 4*a*) and distances $L_{35}$ and $D_{35}$ must be appropriately chosen.

Figure 3A:
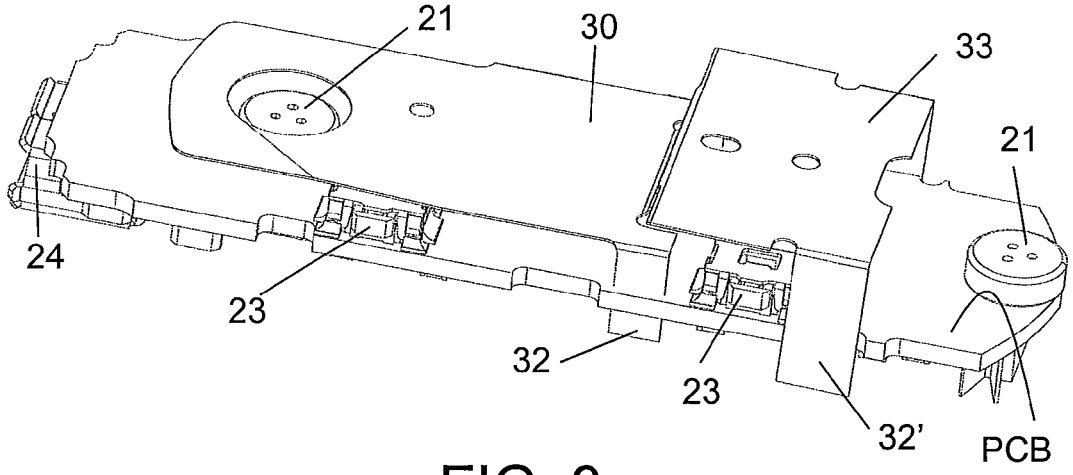
FIG. 3 shows three different views of structural parts of a communication device (including an embodiment of an antenna), FIG. 3*a* being a perspective view of the device without a top cover, FIG. 3*b* being a side view of the device including a top cover, and FIG. 3*c* being a top view of the device without a top cover.
Figure 3B:
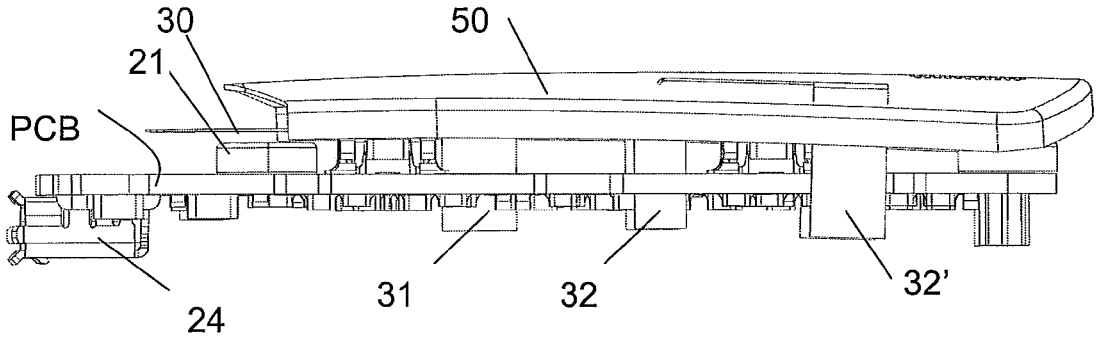
Figure 3C:
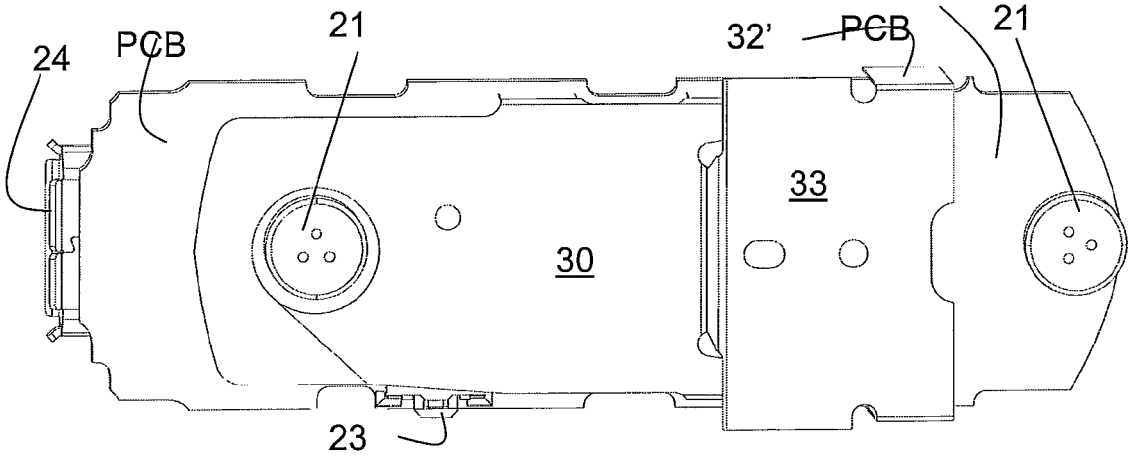

FIG. 3 shows three different views of structural parts of a communication device (including an embodiment of an antenna), FIG. 3*a* being a perspective view of the device without a top cover, FIG. 3*b* being a side view of the device including a top cover, and FIG. 3*c* being a top view of the device without a top cover. The communication device of FIG. 3 is a headset, comprising a signal path with a microphone 21 for picking up a sound signal and converting it to an electrical signal, a signal processor for processing the electrical signal and a speaker unit for presenting a processed signal to a wearer of the headset as a sound. The head set further comprises a transceiver unit for receiving and/or transmitting a wireless signal comprising an audio signal (e.g. from/to a cell phone). The signal presented to a user may—depending on the application—be based on a wirelessly received signal or on the microphone signal (or both). In some applications, e.g. headset, the signal presented to a user is primarily based on the wirelessly received signal, whereas the microphone signal (or both) is less frequently used. In some applications, e.g. hearing aid, the microphone and wirelessly received signals are primarily used in each their respective situations (a wirelessly received signal being e.g. primarily used during a telephone conversation and a microphone signal being primarily used in a normal face-to-face communication). A signal transmitted from the headset may be a signal based on the signal picked up by the microphone (e.g. including a user's own voice). The device comprises a multi-layer PCB (e.g. comprising 4 layers) comprising a ground-plane as an intermediate layer and to which electronic components are attached to the top and bottom layers. Microphone units 21 and user-operable push buttons 23 are examples of components attached to the top side of the PCB. An USB-socket 24 is an example of a component attached to the bottom side of the PCB. An antenna part 30 (a half wavelength loop antenna part, here the layer shown is an insulating layer attached to the loop (not the loop layer); the loop layer is schematically shown in FIG. 4) is located to be coplanar to the PCB a predefined distance from the PCB. The antenna part has electrical connections 32 to the ground plane.

The loop antenna comprises a grounded part 33. The purpose of part 33 is to establish an RF Short Circuit (by use of capacitive coupling mechanism) to the top cover 50. This RF Short Circuit is advantageous to avoid a galvanic connection between the top cover and the ground plane due to ESD considerations.

The purpose of part 33 in conjunction with connection(s) 32 is to establish an RF Short Circuit connection between the top cover and the ground plane (10 in FIG. 2), such that a resonant length of a quarter wavelength of the top cover is established.

The purpose of part 33 in conjunction with connection(s) 32' is to establish an RF Short Circuit connection, between the top cover and the ground plane (10 in FIG. 2), such that the part of the top cover, which is not used as antenna, is inhibited from working as an additional antenna (which could make the impedance matching/tuning of the antenna difficult).

In the embodiment of FIG. 3, this grounding part 33 is electrically connected to the loop antenna part 30 (for manufacturing reasons) but is located closer to the parasitic patch 50 than the loop antenna part 30. This is achieved in that the structure 30, 33 is bent to form a step near the loop antenna grounding terminals 32.

Figure 4A:
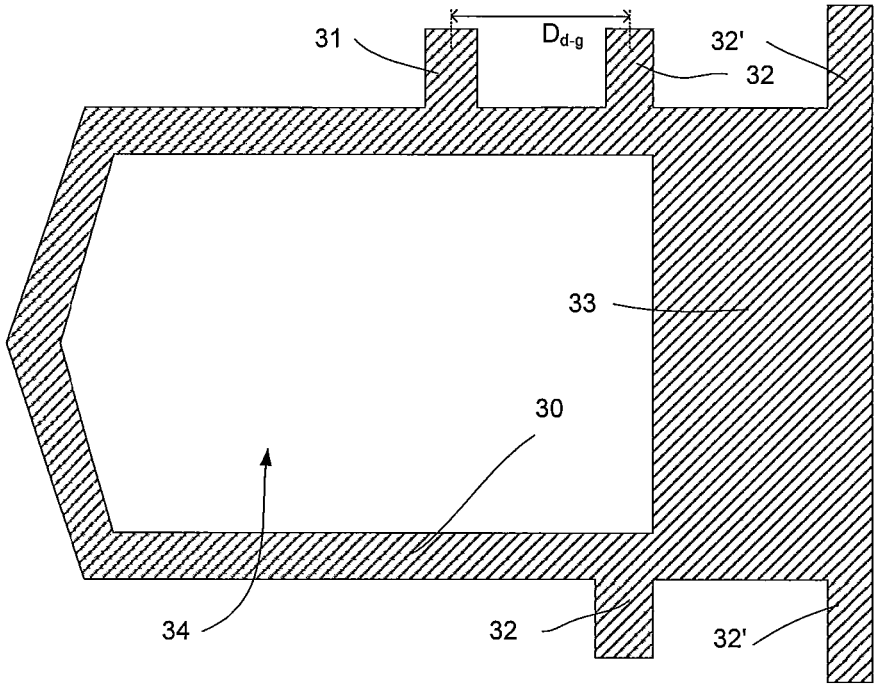
FIG. 4 shows a schematic example of a print layout of a driven loop antenna part of an antenna for a communication device according to an embodiment of the invention.
Figure 4B:
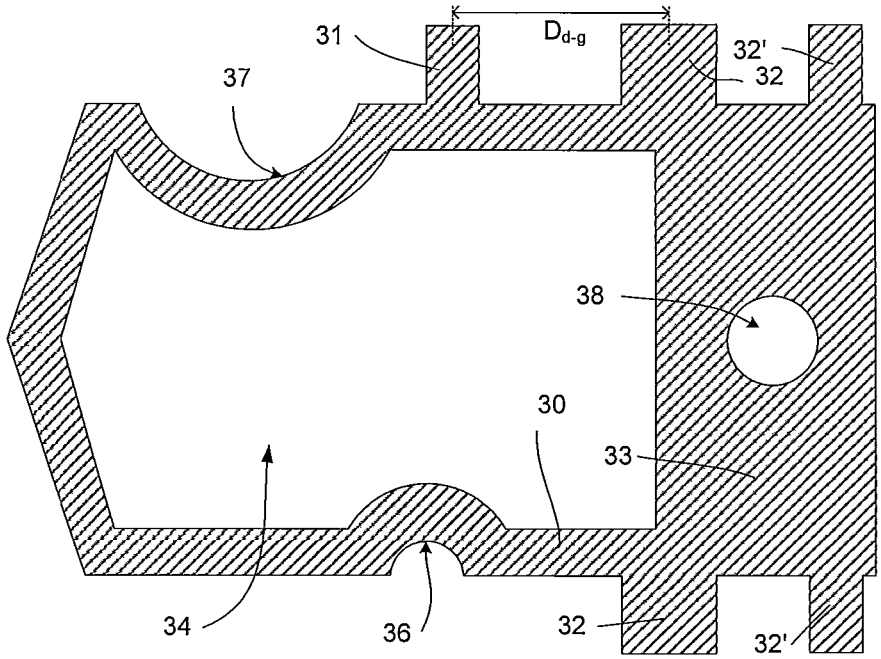
Figure 5:
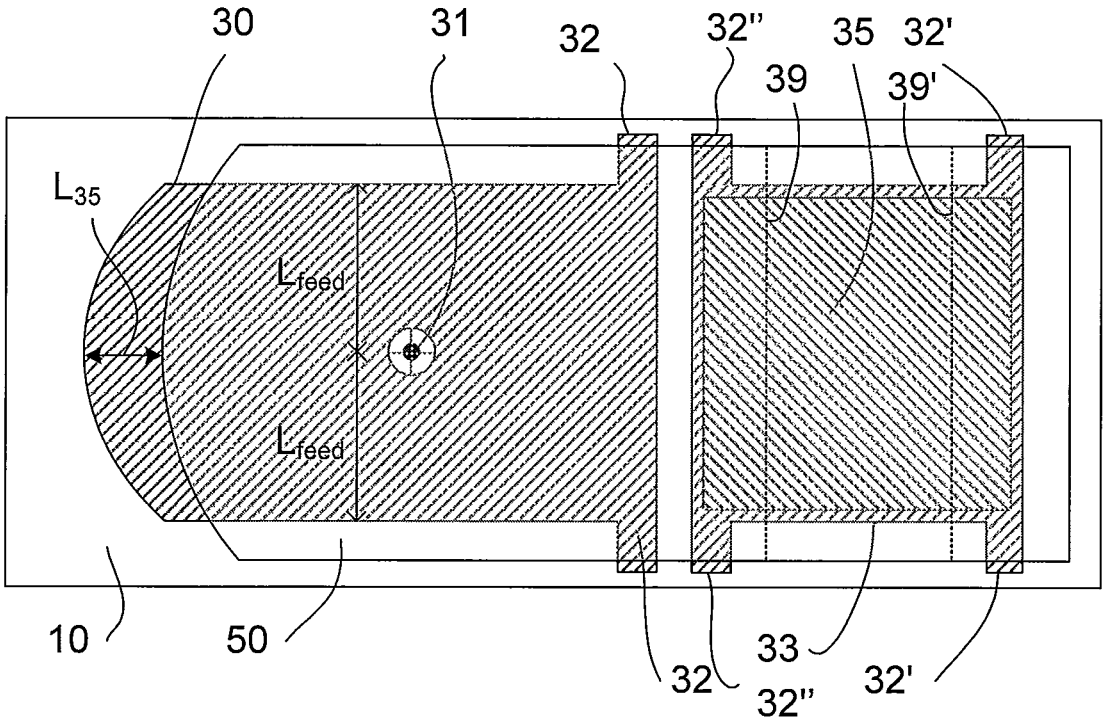
FIG. 5 illustrates a top view (with partial transparency) of an example of a stacked antenna structure according to an embodiment of the invention.

Alternatively the loop antenna 30 and grounding 33 parts could be two separate—electrically un-connected—parts (cf. e.g. FIG. 5). This requires grounding terminal(s) 32 to be duplicated, which is shown as connection(s) 32" in FIG. 5 (originally, connection(s) 32 were shared by parts 30 and 33 in FIG. 4). The loop antenna part is fed from terminal 31 (in FIG. 3 and FIG. 4) from one side of the loop. The feeding terminal 31 is connected to one or more transceiver components on the PCB.

The driven antenna could alternatively be a quarter wavelength patch antenna, e.g. centrally fed, in the up-down-direction from below (cf. e.g. FIG. 5), cf. equal distances $L_{feed}$ from the top and bottom edges of the driven quarter wavelength patch antenna to the driving point (the left-right-position is used for providing proper antenna impedance matching). Apart from that, the same electrical and mechanical features as discussed for the half wavelength loop antenna can be implemented with the patch antenna.

FIG. 4*a* shows a schematic example of a print layout of a driven loop antenna part of an antenna for a communication device according to an embodiment of the invention (e.g. for use as the driven antenna of the device of FIG. 3). The loop antenna comprises a loop 30 and a pair of grounding terminals (flaps) 32 for being connected to a ground plane. The first pair of grounding terminals 32 determine limits of the physical length ($\lambda_c/2$) of the loop antenna (as defined in FIG. 2*b*). The loop antenna further comprises a driving terminal (flap) 31 for being electrical connected to a transceiver for driving the antenna and for receiving a signal picked up by the antenna. The distance $D_{d\text{-}g}$ between the driving terminal 31 and ground terminal 32 is adapted to achieve a 50 ohm impedance matching. The distance between the driving terminal 31 and a ground terminal 32 is preferably in the range from $0.1\cdot(\lambda_c/2)$ to $0.3\cdot(\lambda_c/2)$, such as in the range from $0.15\cdot(\lambda_c/2)$ to $0.25\cdot(\lambda_c/2)$, e.g. around $0.2\cdot(\lambda_c/2)$. The part 33 of the antenna to the right of the ground connections 32 can e.g. be used to implement an RF (capacitive) ground coupling to the first patch antenna (50 in FIGS. 2 and 3). The parts 33, 32 and 32' in FIG. 4 have the same purpose as in FIG. 3. The loop opening 34 can be adapted to the application in question, e.g. to enable electronic components to extend through the opening, thereby allowing a more compact device structure. Similarly the outer periphery can be adapted in form to comply with other restrictions of the device, e.g. to allow components (e.g. components extending through the housing, e.g. a button, cf. 23 in FIG. 3) to be located along its periphery as exemplified by FIG. 4*b*. In the embodiment of the loop antenna part of FIG. 4*b* (which is largely identical to the embodiment of FIG. 4*a*, except for the features described in the following) indentations in the periphery of the loop are shown with reference numerals 36 and 37. In the embodiment of FIG. 4*b*, the coupling part 33 of the loop antenna further comprises an opening 38 to be used for mutual part alignment during assembly.

FIG. 5 illustrates a top view (with partial transparency) of an example of a stacked antenna structure according to an embodiment of the invention. The stacked antenna structure comprises a ground plane 10, a driven antenna part 30 (here a quarter wavelength patch antenna), and a parasitic quarter wavelength patch antenna form part of the top cover 50 of a portable electronic device. The driven patch antenna 30 has an overhang of length $L_{35}$, e.g. 1 mm compared to the parasitic patch antenna 50 forming part of the housing of the device. The driven patch antenna 30 is connected to ground 10 by ground terminals 32. The driven patch antenna 30 is fed from a centrally located feeding terminal 31. The feeding terminal is approximately located at the geometrical centre in the up-down-direction (the left-right-position is used for proper antenna impedance matching) of the patch structure. The driven patch end comprising the two ground terminals 32 defines a 'cold end' of the driven patch antenna and the (opposite) leftmost end defines a 'hot end' of the driven antenna 30 (the distance between the cold and hot ends being approximately one quarter of an operating wavelength). The part 33, to the right of the driven patch 30, comprises a piece of conductive material. The purpose of part 33, is to establish an RF Short Circuit (by use of capacitive coupling mechanism) to the top cover 50. This RF Short Circuit is advantageous, because a galvanic connection between the top cover 50 and the ground plane 10 is not feasible due to ESD requirements.

The purpose of part 33 in conjunction with connection(s) 32", is to establish an RF Short Circuit connection, between the top cover 50 and the ground plane 10, thereby defining a 'cold end' of the parasitic patch antenna (line 39), the leftmost end defining a 'hot end' of the parasitic patch antenna 50 (this distance being approximately one quarter wavelength).

The purpose of part 33 in conjunction with connection(s) 32', is to establish a RF Short Circuit connection (indicated by line 39'), between the top cover 50 and the ground plane 10, such that, the part of the top cover 50, which is not used as antenna, is inhibited from working as an additional antenna (which could make the impedance matching/tuning of the antenna difficult).

The capacitive coupling to the top cover 50 is controlled by dielectric material 35. The dielectric material 35 could be a polyimide layer (e.g. in combination with an oxide layer of an anodized aluminium top cover) of a flex-PCB or of an ESD protective tape, between the electrically conductive part 33 and the electrically conductive top cover 50. The area of the dielectric layer 35 is adapted to provide an RF-impedance of the resulting capacitor that is sufficiently small to provide an effective RF-short circuit of the top cover to the ground plane 10.

The $\lambda/4$ patch driven antenna 30 of FIG. 5 can alternatively be substituted by a $\lambda/2$ driven loop antenna. In that case, the central driving point of FIG. 5 should be substituted with a driving terminal along one of the edges of the loop (as indicated by terminal 31 in the example of FIG. 4) the location of the driving terminal being located on the edge to provide a predefined impedance, e.g. a 50Ω impedance.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

WO 2007/019885 A1 (GN NETCOM) 22 Feb. 2007

US 2006/0109182 A1 (Sony Ericsson Mobile Comm.) 25 May 2006

US 2006/0109183 A1 (Sony Ericsson Mobile Comm.) 25 May 2006

The invention claimed is:

1. A communication device, comprising:

a wireless interface for enabling wireless transmission and/or reception at a predefined wavelength $\lambda_c$ to be established, the wireless interface including an antenna having a stacked structure; and a housing having an electrically conductive part, said housing being a structural part of the communication device enclosing and/or supporting components constituting the communication device, including electronic components of the communication device, wherein the antenna includes a first quarter wavelength patch, and a ground plane comprising an electrically conductive material, the stacked structure includes a first layer including the ground plane including an electrically conductive material, a second layer including an electrically insulating material, a third layer including a second patch including an electrically conductive material, the second patch being electrically connected to the ground plane, said second patch being adapted to constitute a quarter-wavelength antenna at said predefined wavelength λc, a fourth layer including an electrically insulating material, and a fifth layer comprising the first patch including an electrically conductive material, the first quarter wavelength patch is at least partially constituted by said electrically conductive part of the housing, the stacked structure is configured to provide that the first patch of the fifth layer is electromagnetically coupled to the second patch of the third layer, the second patch is a driven antenna, and the first patch is parasitically coupled to the second patch.

2. A communication device according to claim 1 wherein the first quarter wavelength path is defined by a radiating end and an end comprising one or more electrical connections to the ground plane.

3. A communication device according to claim 1 wherein the antenna comprises an intermediate, driven, quarter wavelength patch that is electromagnetically coupled to the first quarter wavelength patch.

4. A communication device, comprising:

a wireless interface for enabling wireless transmission and/or reception at a predefined wavelength $\lambda_c$ to be established, the wireless interface comprising an antenna having a stacked structure; and a housing having an electrically conductive part, said housing being a structural part of the communication device enclosing and/or supporting components constituting the communication device, including electronic components of the communication device, wherein the stacked structure includes a first layer comprising a ground plane comprising an electrically conductive material, a second layer comprising an electrically insulating material, a third layer comprising a shorted loop comprising an electrically conductive material, the ends of the loop being electrically connected to the ground plane, said loop being adapted to constitute a half-wavelength antenna at said predefined wavelength $\lambda_c$, a fourth layer comprising an electrically insulating material, and a fifth layer comprising a patch comprising an electrically conductive material, said patch being adapted to constitute a quarter-wavelength antenna at said predefined wavelength $\lambda_c$, the stacked structure is adapted to provide that the patch of the fifth layer is electromagnetically coupled to the shorted loop of the third layer, the quarter-wavelength patch of the fifth layer of the antenna is at least partially constituted by said electrically conductive part of the housing, the shorted loop is a driven antenna, and the patch of the fifth layer is parasitically coupled to the shorted loop.

5. A communication device according to claim 1, wherein the stacked structure comprises a sixth layer comprising an electrically insulating material at least partially covering said first patch of the fifth layer.

6. A communication device according to claim 1 wherein said ground plane is formed on an insulating substrate, such as a printed circuit board.

7. A communication device according to claim 6 wherein said insulating substrate supports a number of electrically connected components forming part of the communication device.

8. A communication device according to claim 6 wherein said second layer comprises said insulating layer of a said insulating substrate.

9. A communication device according to claim 4 wherein said loop is constituted by a single closed loop of a metallic material.

10. A communication device according to claim 1, wherein the fourth layer comprises a layer of polyimide.

11. A communication device according to claim 1, wherein the fourth layer comprises a plastic part which forms part of the housing of the communication device.

12. A communication device according to claim 1 wherein the wireless interface comprises a transceiver for driving the antenna and/or receiving signals from the antenna, and wherein the driven antenna is electrically coupled to said transceiver.

13. A communication device according to claim 12 wherein said transceiver is at least partially implemented by one or more electronic components on said insulating substrate.

14. A communication device according to claim 4, wherein the stacked structure is arranged to have a longitudinal direction in a direction parallel to the ground plane of the first layer, the shorted loop or patch having a first shorted end connected to the ground plane and a second radiating end when viewed in said longitudinal direction, the ground plane extending in said longitudinal direction beyond the shorted loop or patch, respectively, at least in said radiating end of said antenna parts.

15. A communication device according to claim 1 wherein the first patch is the driven patch, so that the antenna structure is constituted by the first patch and the ground plane and an intermediate insulating layer.

16. A communication device according to claim 1 wherein the communication device comprises a headset, an active earplug, a hearing instrument or a headphone or combinations thereof.

17. An antenna comprising a stacked structure, the stacked structure comprising:

a first layer comprising a ground plane comprising an electrically conductive material;

a second layer comprising an electrically insulating material;

a third layer comprising a shorted loop comprising an electrically conductive material, the ends of the loop being electrically connected to the ground plane, said loop being adapted to constitute a half-wavelength antenna at said predefined wavelength $\lambda_c$;

a fourth layer comprising an electrically insulating material; and a fifth layer comprising a patch comprising an electrically conductive material, said patch being adapted to constitute a quarter-wavelength antenna at said predefined wavelength $\lambda_c$, wherein the stacked structure is adapted to provide that the patch of the fifth layer is electromagnetically coupled to the shorted loop of the third layer, the shorted loop is a driven antenna, and the patch of the fifth layer is parasitically coupled to the shorted loop.

18. A communication device according to claim 4, wherein the antenna comprises an intermediate, driven, shorted loop half-wavelength antenna that is electromagnetically coupled to the first quarter wavelength patch.

19. A communication device according to claim 4, wherein the stacked structure comprises a sixth layer comprising an electrically insulating material at least partially covering said first patch of the fifth layer.

20. A communication device according to claim 4, wherein the fourth layer comprises a layer of polyimide.

21. A communication device according to claim 4, wherein the fourth layer comprises a plastic part which forms part of the housing of the communication device.

22. The communication device according to claim 1, wherein the first patch of the fifth layer is electromagnetically coupled to the second patch of the third layer by a capacitive coupling.

23. The antenna according to claim 17, wherein the patch of the fifth layer is electromagnetically coupled to the shorted loop of the third layer by a capacitive coupling.

24. The communication device according to claim 4, wherein the patch of the fifth layer is electromagnetically coupled to the shorted loop of the third layer by a capacitive coupling.

* * * * *